US005540508A

United States Patent [19]

Asada et al.

[11] Patent Number: 5,540,508

[45] Date of Patent: Jul. 30, 1996

[54] PRINT HEAD FOR AN IMPACT DOT PRINTER

[75] Inventors: Takashi Asada; Kazuhiko Yamamoto, both of Suwa, Japan

[73] Assignee: Seiko Epson Corporation, Tokyo, Japan

[21] Appl. No.: 341,280

[22] Filed: Nov. 16, 1994

Related U.S. Application Data

[63] Continuation of Ser. No. 937,798, Aug. 28, 1992, abandoned.

[30] Foreign Application Priority Data

| | | | |
|---|---|---|---|
| Aug. 29, 1991 | [JP] | Japan | 3-218414 |
| Aug. 29, 1991 | [JP] | Japan | 3-218417 |
| Jun. 23, 1992 | [JP] | Japan | 4-164947 |

[51] Int. Cl.[6] ..... B41J 2/265

[52] U.S. Cl. ..... 400/124.12; 400/124.24; 400/124.25

[58] Field of Search ..... 101/93.05; 400/124.01, 400/124.12, 124.24, 124.25, 124.28, 124.31

[56] References Cited

U.S. PATENT DOCUMENTS

| | | | |
|---|---|---|---|
| 3,987,883 | 10/1976 | Darwin et al. | 400/124 |
| 3,991,871 | 11/1976 | McIntosh | 400/124 |
| 4,447,166 | 5/1984 | Ochiai et al. | 400/124 |
| 4,506,999 | 3/1985 | Robertson | 400/121 |
| 4,613,241 | 9/1986 | Kitagawa | 400/121 |
| 5,174,663 | 12/1992 | Asada et al. | 400/124 |

FOREIGN PATENT DOCUMENTS

| | | | |
|---|---|---|---|
| 0067542 | 12/1982 | European Pat. Off. . | |
| 0225782 | 6/1987 | European Pat. Off. | 400/124 |
| 0296637 | 12/1988 | European Pat. Off. . | |
| 0372557 | 6/1990 | European Pat. Off. . | |
| 0461642 | 12/1991 | European Pat. Off. . | |
| 0166065 | 10/1983 | Japan | 400/124 |
| 0199266 | 11/1984 | Japan | 400/124 |
| 0228166 | 11/1985 | Japan | 400/124 |
| 0000528 | 1/1990 | Japan | 400/124 |
| 3-7351 | 1/1991 | Japan . | |

*Primary Examiner*—John S. Hilten
*Attorney, Agent, or Firm*—Stroock & Stroock & Lavan

[57] ABSTRACT

A print head for an impact dot printer capable of printing on a printing medium is provided. The print head includes a plurality of print wires and a front end guide having guide holes for guiding the print wires to predetermined print positions. The front end guide has a front surface through which the print wires extend. A guide holding member is provided for holding the front end guide. Lubricant is injected into a back portion of the front end guide to reduce the friction between the print wires and the front end guide during the printing operation. The printer head includes projection members for holding the ink ribbon away from the guide means. The projection members are provided on the front surface of the guide members. The interface between the front end guide and the nose of the print head is provided with structure for preventing the passage of lubricant therebetween.

57 Claims, 15 Drawing Sheets

FIG.5
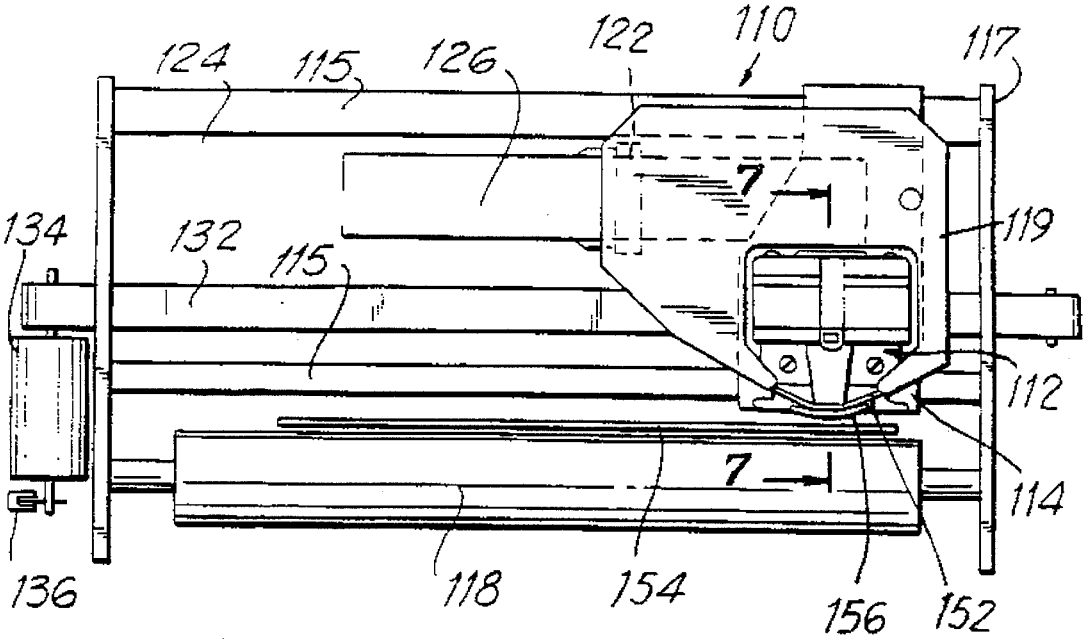
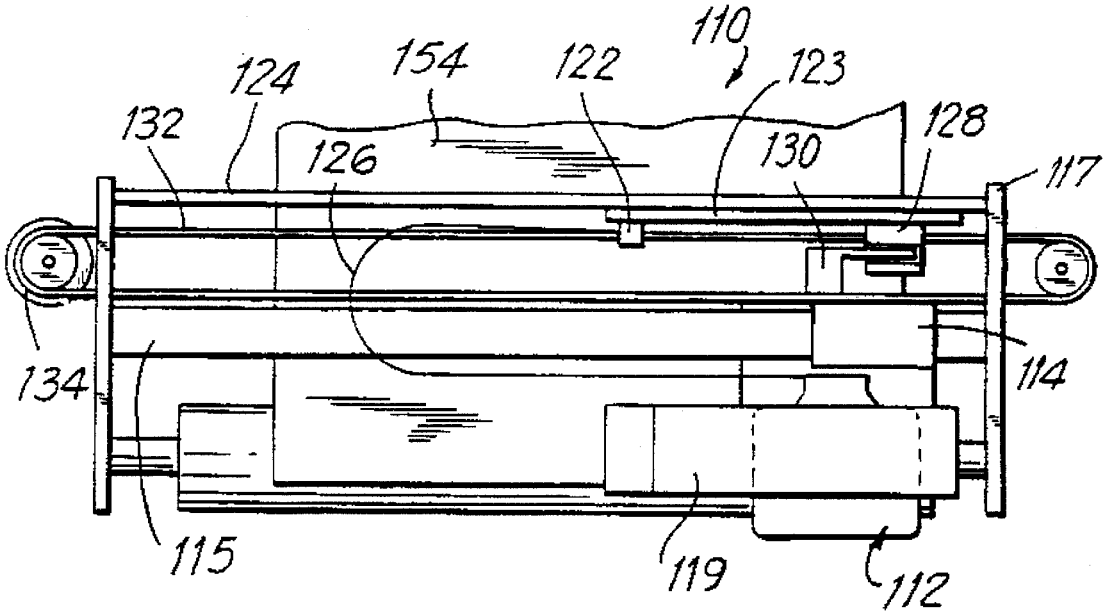
FIG.6

FIG. 10A
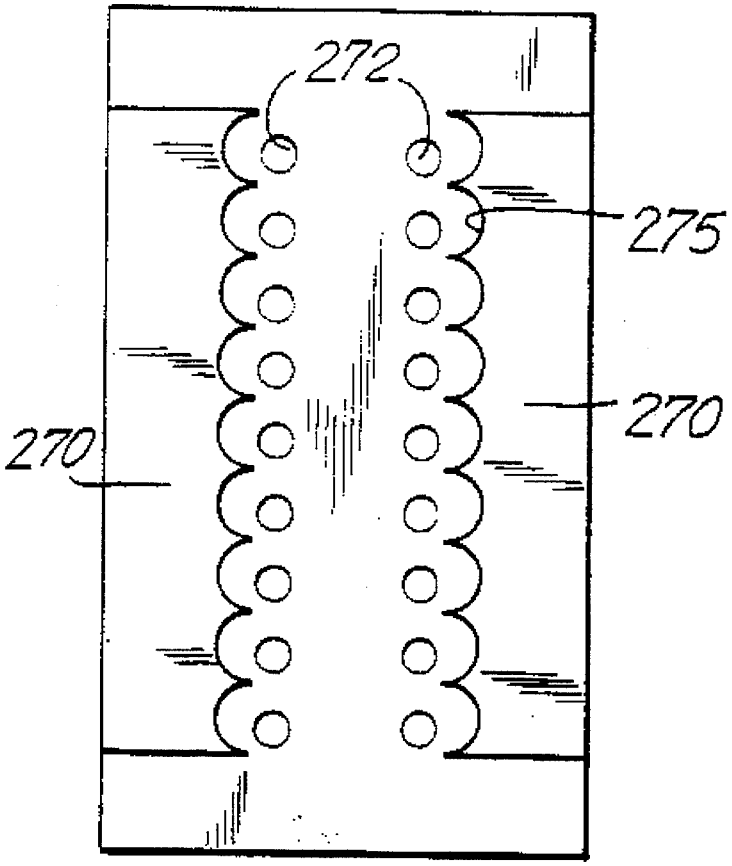
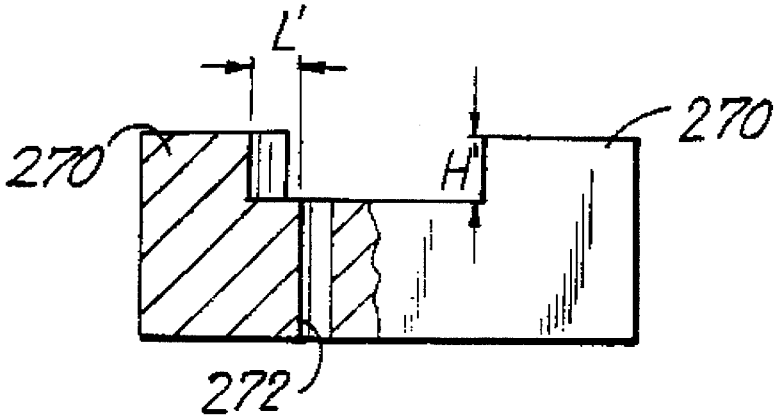
FIG. 10B

PRINT HEAD FOR AN IMPACT DOT PRINTER

This is a continuation of application Ser. No. 07/937,798, filed Aug. 28, 1992, now abandoned.

BACKGROUND OF THE INVENTION

This invention is related to an impact dot printer and, more particularly, to a print head for an impact dot printer which decreases the sliding resistance of the wires through the guide holes and thereby increases the reliability and durability of the print head.

Impact dot printers are known in the art and are exemplified by Unexamined Japanese Patent Publication No. 7351/1991. Such a print head for an impact dot printer as disclosed is conventional.

FIG. 1 of the present application discloses a print head of a conventional impact dot printer which is characterized by injecting a lubricant 20 of an appropriate viscosity at the back of a front end guide 22. The lubricant prevents infiltration of fine particles of ink, ink ribbon scraps, print medium dust, etc., from guide holes 24 of the front end guide 22. When dirt particles such as ink, ink ribbon scraps and print medium dust enter the guide holes 24, the slidability of print wires 26 is impaired and print wires 26 and guide holes 24 undergo increased wear.

A recent trend in impact dot printing is the development of a growing demand for impact dot printers capable of printing on various types of printing papers such as postcards and labels, This has increased the need and accelerated the development of printers that receive printing paper through horizontal insertion. In other words, these new trends have encouraged the development of impact dot printers where the printing paper is inserted horizontally and the printing paper is not required to be bent around a platen as in conventional dot matrix printers. In other words, the print head 30 of a conventional dot matrix printer is mounted in an upright direction to print on paper 29 bent around cylindrical platen 31 as shown in FIG. 2A. On the other hand, the print head 30' is mounted in a face down direction so that a print sheet 29' is laid horizontally on flat platen 31' as shown in FIG. 2B.

FIG. 1 discloses a print head and specifically an expanded view in the vicinity of the tips of wires 26. A wire dot print head of the type disclosed usually operates by print wires 26 directly contacting ink ribbon 32. Ink ribbon 32 is maintained in close proximity to front surface 28 of front end guide 22 and the print wires 26 is driven through opening 33' in mask 33 to strike paper 29' on platen 31'. When the print head is in a standby position, the wires 26 are maintained approximately 0.01 millimeters projected outward from front surface 28 of front end guide 22. Problems occur when the print head 30 is mounted in a face down direction as shown in FIG. 2B for a long period of time. As shown in FIG. 1, the lubricant 20 seeps through guide holes 24 and seeps through clearances or gaps between the front end guide 22 and nose 23 due to the specific gravity of the lubricant used. As a result of lubricant 20 seeping through guide holes 24 and the clearances discussed above, lubricant 20 becomes transferred onto ink ribbon 32.

The lubricant 20 that contacts ink ribbon 32 causes some ink components of ink ribbon 32 to be lost. After the ink components on the ink ribbon 32 have been lost, the operation of the ink ribbon 32 is impaired. In other words, when the wire 26 contacts ribbon 32 in an area where lubricant 26 has been transferred thereon, an ink dot cannot be formed by the contact of wire 26 on lubricant transferred portion 34 of ink ribbon 32 as shown in FIG. 3. Accordingly, when wires 26 contact lubricant transferred portion 34 of ink ribbon 32, ineffective printing occurs as shown by portions 36 of FIG. 4.

Print heads 30, which are mounted in an upright position as disclosed in FIG. 2A, can also suffer from the same deficiencies as those mounted in a face down position because lubricant 20 can leak out of the print head through guide holes 24 when the amount and viscosity control of the lubricant 20 injected at the back of the front end guide 22 is improper. This occurs when the viscosity is too low or there is too much lubricant injected behind the front end guide 22, thereby causing increased pressure and lubricant leakage. Under these circumstances, a print head mounted in the upright position of FIG. 2A suffers similar defects to that shown as portion 36 of FIG. 4.

As a result of the problems disclosed hereinabove regarding leakage of lubricant through the print head, the manufacturing cost of print heads has increased because strict control over the viscosity and amount of lubricant injected into the back of the front end guides of the print heads is required, even if the head is mounted in the upright position. Furthermore, when the print head is mounted in a face down position as disclosed in FIG. 2B, the prior art devices have been required to stop injecting lubricant at the back of the front end guide completely, in order to prevent defective printing as described hereinabove with regard to FIGS. 3 and 4. As a result of eliminating the use of lubricant, there have been noticeable losses in reliability, durability and printing quality. These losses are due not only to wear of the guide holes of the front end guide, but also to increases in sliding resistance of the wires due to ink, paper dust and ribbon scraps infiltrating into the guide holes and due to picking up of the ribbon by the wires.

Accordingly, it is desirable to provide a print head for an impact wire dot printer wherein the print head can be mounted in either an upright or a face down position, and lubricant can be injected at the back of the front end guide to prevent defective printing. Further, it is desirable to decrease the cost of production of the print head by decreasing the degree of monitoring required with regard to the viscosity and amount of lubricant injected at the back of the front end guide.

SUMMARY OF THE INVENTION

Generally speaking, in accordance with the invention, a print head for an impact dot printer includes a plurality of print wires and a guide member having holes for guiding the print wires to predetermined print positions. A nose piece (guide holding member) is provided for holding the guide member.

The print head receives a lubricant injected into a back portion of the guide member and performs a printing operation by striking an ink ribbon located between the guide member and the printing medium against the printing medium. The striking is performed by the print wires being projected out of the guide holes of the guide member at appropriate times. Projection members are provided for biasing the ink ribbon away from the guide member. The projection members are located on a surface of the guide member on the side of the guide member facing the ribbon. By biasing the ink ribbon away from the guide member, the print head may be mounted either in an upright position or a face down position without fear of lubricant leaking from the back of the guide member and contacting the ink ribbon due to a close proximity of the ink ribbon to the front surface of the guide member.

Another feature of the invention is that the guide member and guide holding member are configured so as to fit together by friction or other predetermined means such that there is minimal seepage of lubricant between the guide member and nose piece.

Accordingly, it is an object of the present invention to provide an improved print head for an impact dot printer which eliminates or minimizes the quantity of lubricant that seeps out from behind the guide member and onto the ink ribbon.

It is another object of the present invention to provide an improved head for an impact dot printer which is capable of being mounted face down while reducing the amount of seepage of lubricant onto the ink ribbon.

It is yet another object of the present invention to provide an improved print head for an impact dot printer which increases the reliability, durability and printing quality of the impact dot printer by providing proper lubrication of the print wires within the guide holes without allowing seepage of lubricant onto the ink ribbon.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a front elevational view showing impact dot printer of the present invention;

FIG. 6 is a top plan view of the impact dot printer of FIG. 5;

FIG. 10A is a top plan view of a guide member in accordance with a second embodiment of the invention;

FIG. 10B is a partially sectional front elevational view of the guide member of FIG. 10A;

DETAILED DESCRIPTION OF THE PREFERRED EMBODIMENTS

Figure 1:
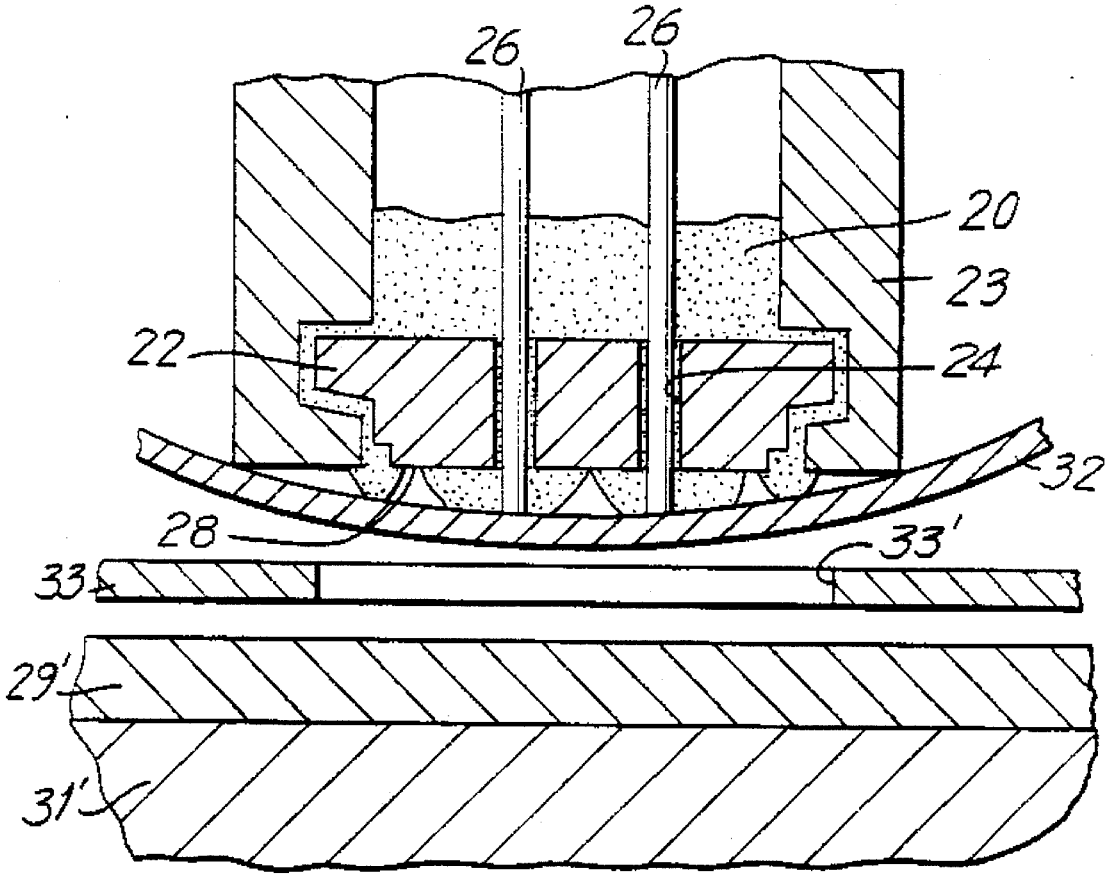
FIG. 1 PRIOR ART
FIG. 1 is a sectional view of a conventional front end guide of an impact dot matrix print head.
Figure 2A:
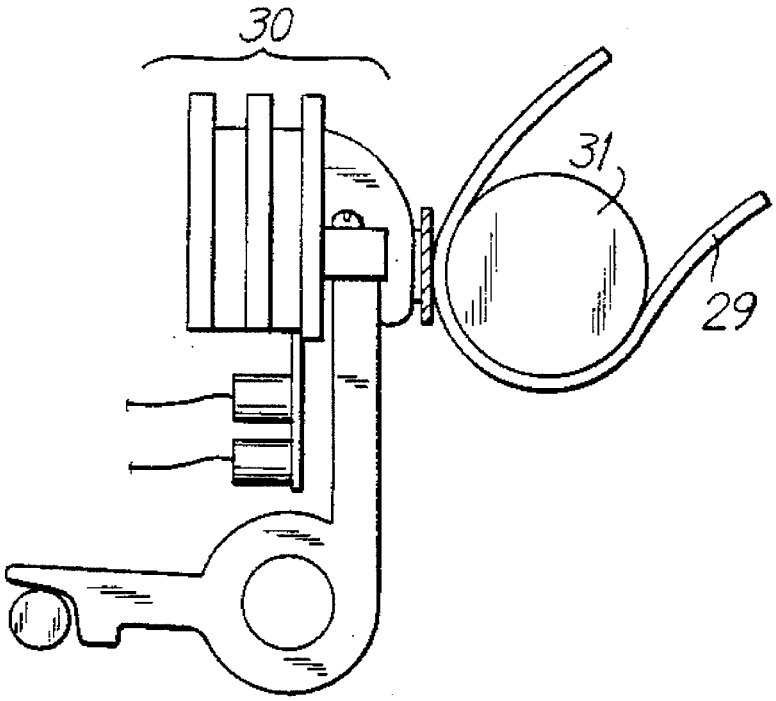
FIG. 2A PRIOR ART
FIG. 2A is a side view of a conventional print head mounted in a upright position.
Figure 2B:
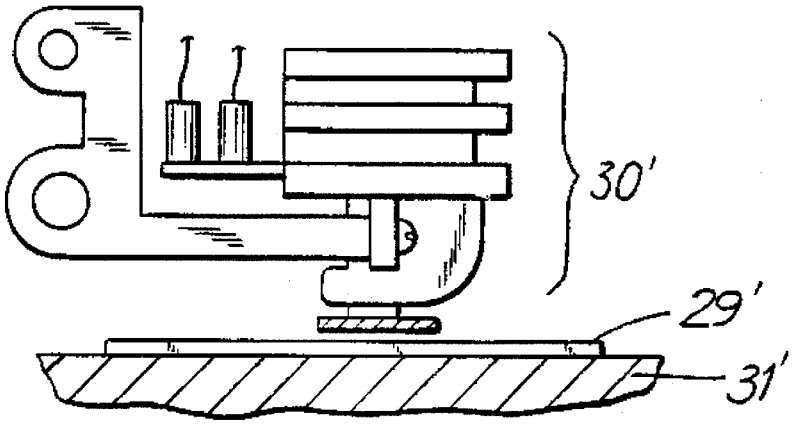
FIG. 2B PRIOR ART
FIG. 2B is a side view of a print head mounted in a face down direction.
Figure 3:
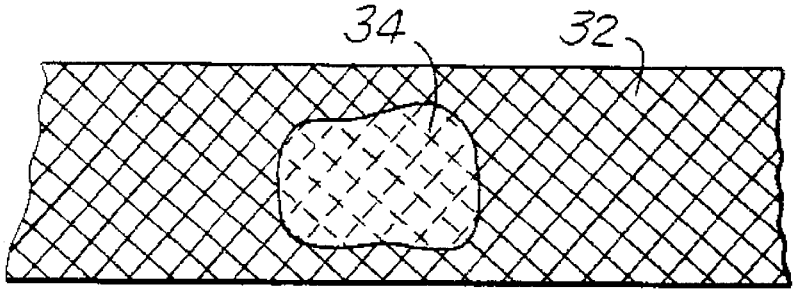
FIG.3 PRIOR ART
FIG. 3 is a top plan view of a section of ink ribbon depicting a lubrication stain on the ribbon causing a print problem.

The drawings generally depict the construction of a impact dot printer, and, in particular, the print head of an impact dot printer, or portions thereof for preventing leakage of lubricant onto an ink ribbon.

FIGS. 5 and 6 depict an impact dot printer, generally indicated as 110, and, in particular, the print head thereof, generally indicated as 112. Print head 112 is carried on a carriage 114 which supports print head 112 and allows print head 112 to move reciprocally in a horizontal direction (as seen in FIGS. 5 and 6), orthogonal to the direction of motion of print sheet 154 by platen 118. Carriage 114 rides on rails 115 supported on frame 117 for reciprocal displacement. An ink ribbon cartridge 119 is mounted on carriage 114 and carries ink ribbon 152. A mask 156 is positioned between paper 154 and ink ribbon 152. Print head 112 moves with carriage 114 and produces the desired characters, graphics and the like on print sheet 116.

Electrical connector 122 carried on circuit board 123 and mounted on plate 124 and print head 112 are connected to each other by a flexible print cable 126 to a head drive circuit (not shown) electrically coupled to print head 112. A photocoupler 128 is provided on circuit board 123 on plate 124 and detects a home position of carriage 114 by sensing the presence or absence of a fin 130 passing through photocoupler 128. Fin 130 is mounted on carriage 114.

Carriage 114 is driven in the horizontal direction as seen in FIGS. 5 and 6 by drive belt 132, which receives its driving force from carriage drive motor 134. An encoder 136 is mounted on the carriage drive motor 134 and generates a signal for detecting the position of carriage 114. From this signal, a reference print timing signal is generated.

The basic print operation of the impact dot head and the basic construction of parts of print head 112 are discussed with reference to FIG. 7. The print head includes a plurality of print wires, in this case twenty four, each coupled to an electromagnet 140 by a lever 138 pivotable about member 139 and held in position by spring member 137. Lever 138 is biased in the position shown by the upper lever in FIG. 7 by a spring 141. Electromagnets 140 are energized at appropriate times by a driving current applied through circuit board 143 and the electromagnetic attracting force F generated thereby causes print wires 142 to project in the direction indicated by arrow C as shown by the lower print wire in FIG. 7. Each wire 142 is supported by one or more guides. Particularly, the tip of each wire 142 is supported by a front end guide member 144, which is held in place by a nose 146 which serves as a guide holding member. A lubricant 150 is injected into and preferably stays in a portion of the print head located behind the front end guide 144. Lubricant 150 may include, for example, naphthene oil, paraffin oil and olefin oil. When print wires 142 are energized, they project in the direction of ink ribbon 152 and print sheet 154. The print sheet 154 abuts against the platen 124, which serves as a resilient end stopper.

A ribbon mask 156 is located between print sheet 154 and ink ribbon 152. The ribbon mask includes an opening 156' larger than the area in which the print wires 142 are arranged. The ribbon mask 156 is provided to prevent the print sheet 154 from being stained by the ink ribbon 152. Staining occurs when the ink ribbon 152 comes in direct contact with print sheet 154 other than upon impact by a print wire. Ink marks are formed on the surface of print sheet 154 by print wires 142 being projected axially outboard and impacting the surface of print sheet 154 through ink ribbon 152 and thereby causing ink from ink ribbon 152 to be deposited on print sheet 154.

Figure 7:
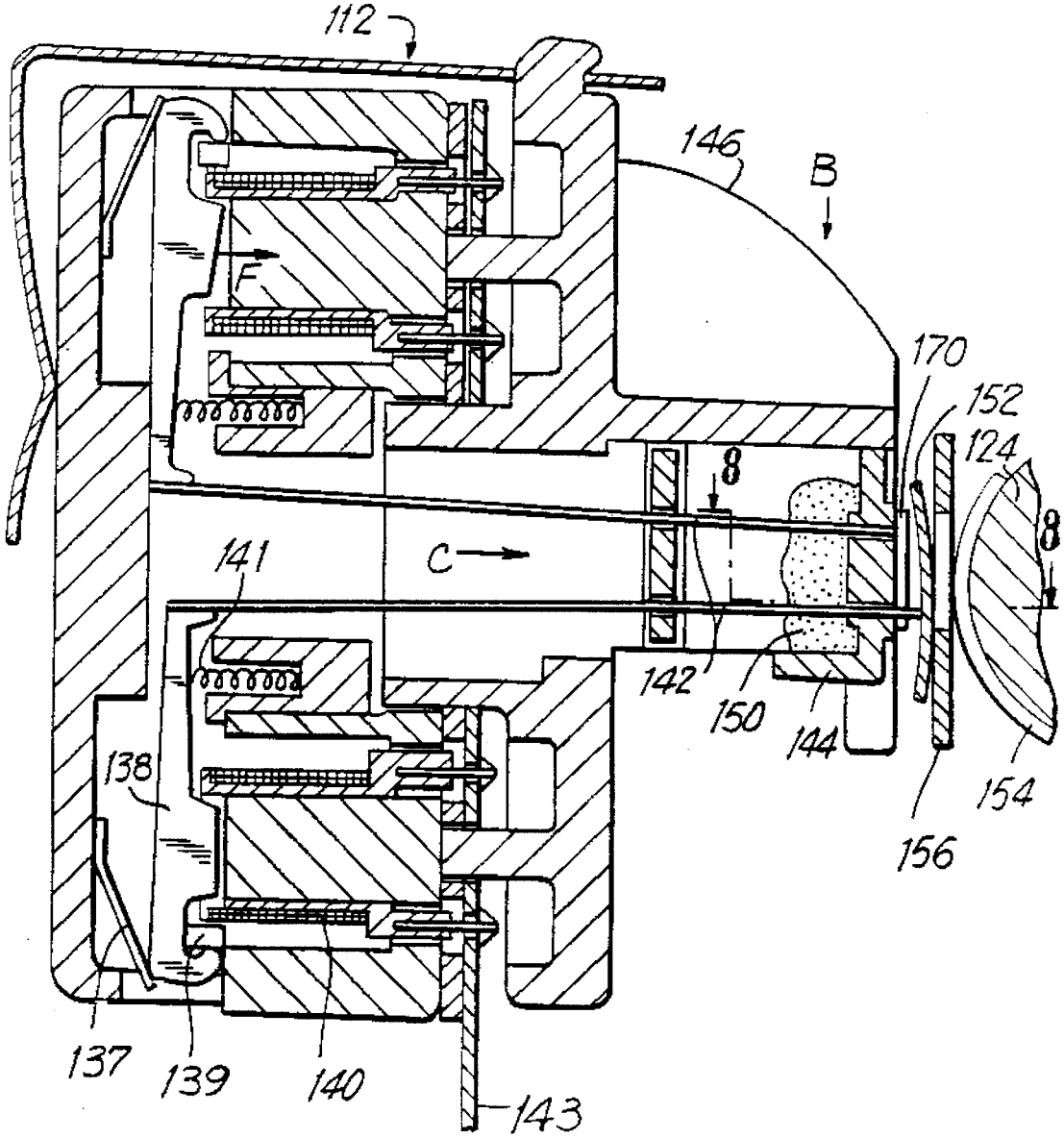
FIG. 7 is an enlarged cross-sectional view taken along lines 7—7 of FIG. 5, showing a print head of a first embodiment of the invention.
Figure 8:
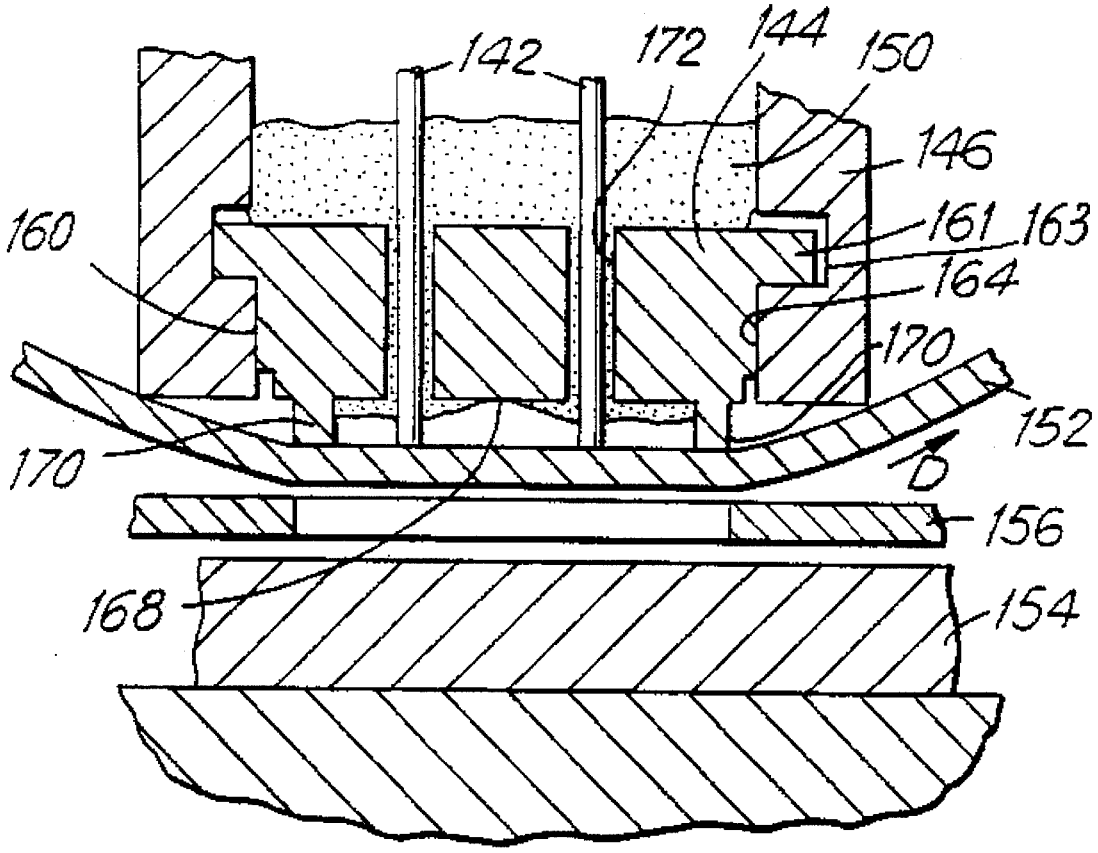
FIG. 8 is a further enlarged, fragmentary, sectional view taken along lines 8—8 of FIG. 7, showing the front end of a print head guide member but with the print wires at a rest position.
Figure 9:
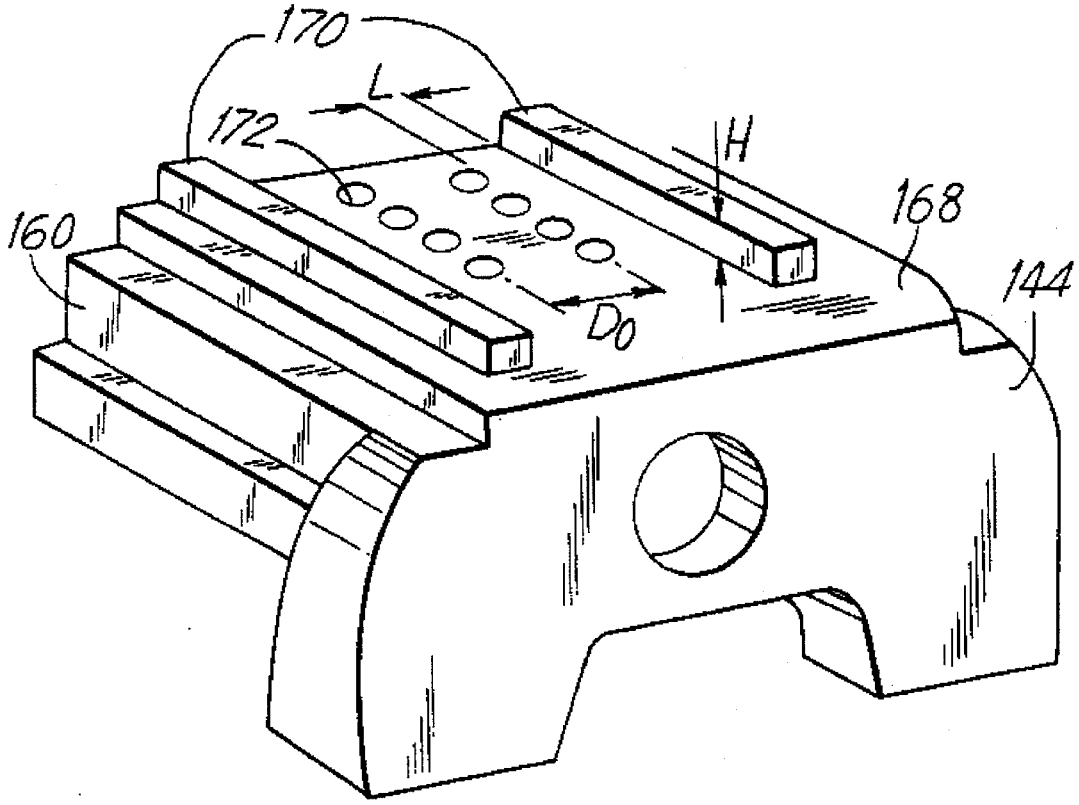
FIG. 9 is a perspective view showing a guide member in accordance with a first embodiment of the invention.
Figure 11A:
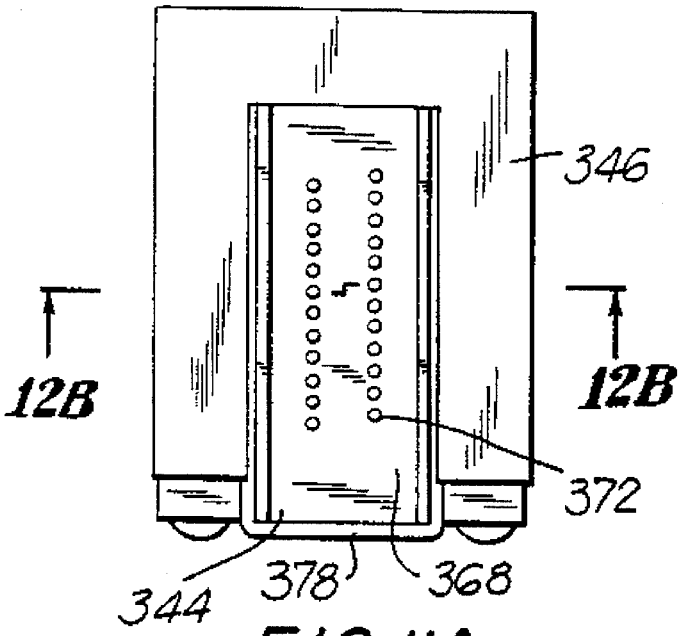
FIG. 11A is a front elevational view of a print head showing a third embodiment of a guide member in accordance with the invention.
Figure 11B:
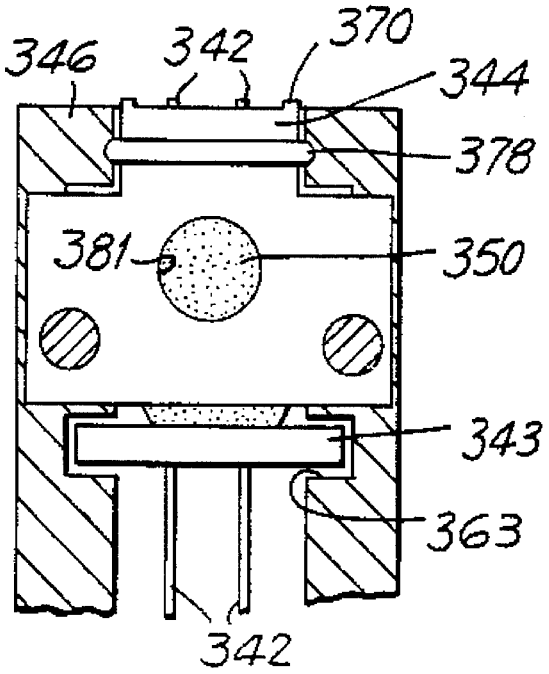
FIG. 11B is a side elevational view of the guide member of FIG. 11A.
Figure 12A:
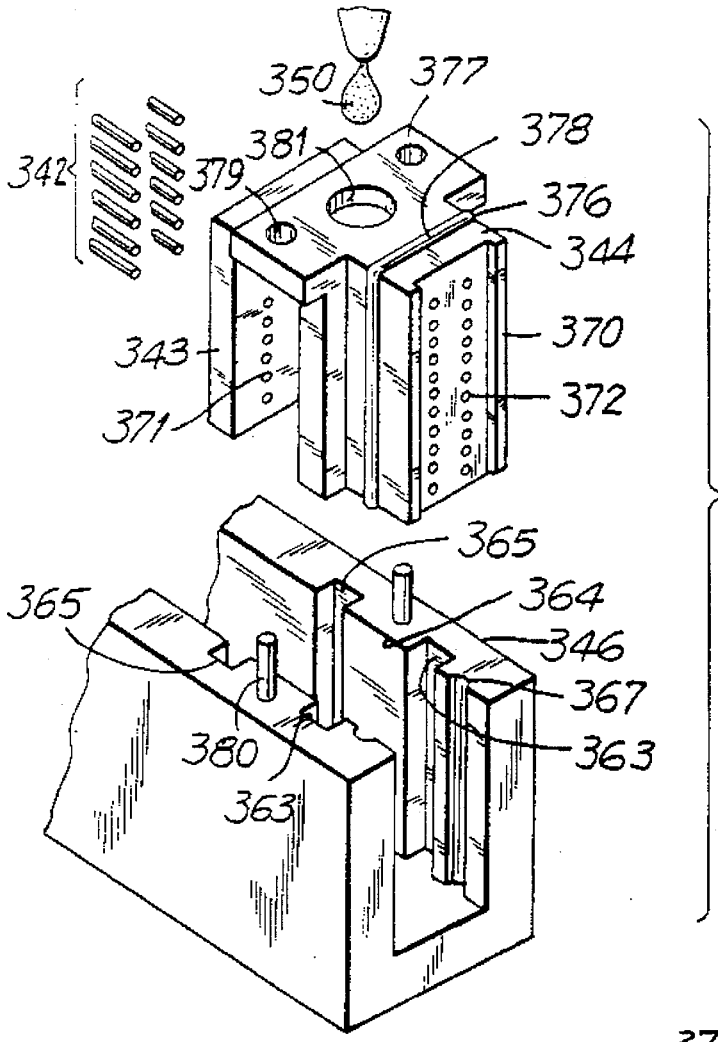
FIG. 12A is an exploded fragmentary perspective view showing the third embodiment of the invention.
Figure 12B:
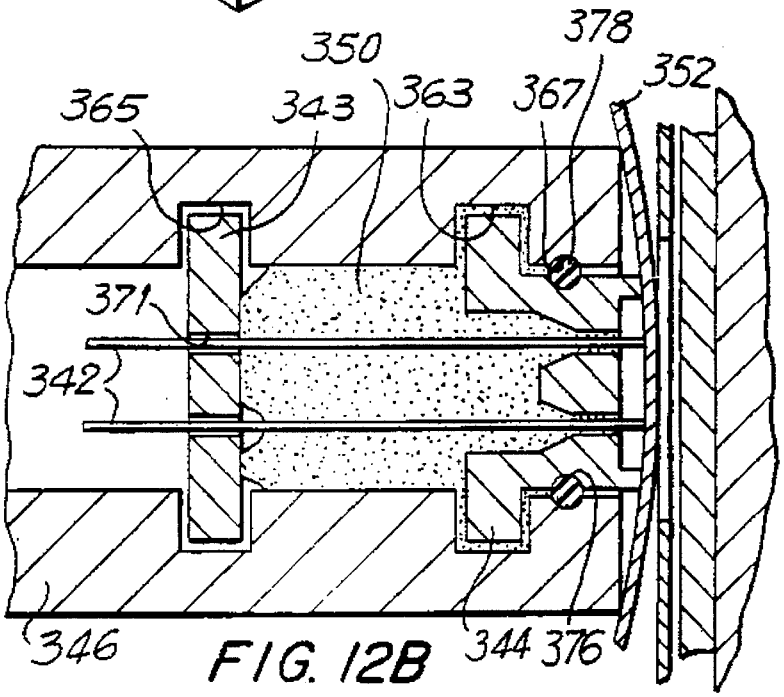
FIG. 12B is a cross-sectional view of the assembled front end of the print head taken along line 12B—12B of FIG. 11A.

Referring now to FIGS. 7–9, a front end guide member 144 constructed in accordance with a first embodiment of the present invention is depicted. Front end guide 144 is secured by nose 146, also known as the guide holding member. Side surface 160 of front end guide member 144 is press-fitted into the space between inner walls 164 of nose 146 to form tight contact between the front end guide member 144 and nose 146. Guide member 144 is provided with a rib 161 on each side thereof which rides in grooves 163 on the inner walls of nose 146 to position the guide member relative to the nose.

The ink ribbon 152 is rewound by a rewinder (not shown) in a direction indicated by arrow D in FIG. 8. Ink ribbon 152 is in contact with the tips of print wires 142 of print head 112 when ink ribbon 152 is under the appropriate tension. In this embodiment of the invention, a pair of spaced projections 170 are provided on the front surface 168 (wire projecting side) of the front end guide 144. Projections 170 provide a predetermined distance between ink ribbon 152 and the front surface 168 of front end guide 144 in order to prevent any lubricant 150 which may have leaked out from contacting ink ribbon 152.

Figure 4:
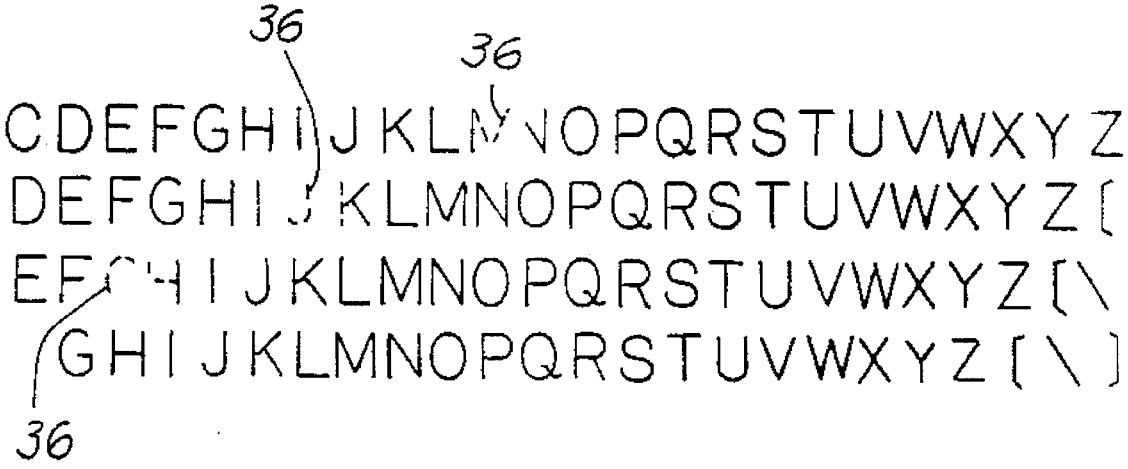
FIG.4 PRIOR ART
FIG. 4 is a depiction of a printout exemplifying the situation when an ink ribbon as depicted in FIG. 3 is used.

Lubricant 150, which is injected into print head 112 in a portion behind front end guide 144, leaks out onto front surface 168 (wire projecting side) of front end guide 144 through the guide holes 172 under normal use conditions. However, lubricant 150 does not flow out of front end guide 144 through spaces or clearances between the side surfaces 160 of front end guide 144 and the surfaces 164 of nose 146 when designed in accordance with the present invention. This is due to the tight contact between side surfaces 160 and surfaces 164. The lubricant 150 that seeps through guide holes 172 of front end guide 144 is prevented from contacting ink ribbon 152 by projections 170 which maintain ink ribbon 152 a minimum distance away from front surface 168 of front end guide 144. Therefore, lubricant 150 is not transferred onto ink ribbon 152 and defective printing such as shown by portions 36 of FIG. 4 is eliminated.

In the first embodiment of the invention disclosed in FIGS. 8 and 9, the diameter of each print wire 142 is set to 0.2 mm, the distance $D_o$ between the two lines of guide holes 172 of front end guide 144 is set to 1/30 inch and the distance of projection of each print wire 142 away from front surface 168 of front end guide 144, when in the standby position, is set to 0.01 mm. As a practical matter, when the height H of each projection 170 is set to a value equal to the amount of projection of the print wire 142 from the front surface 168 of front end guide 144 in the standby position (0.01 mm or more) and a distance L between the projection and an edge point of the guide holes 172 is set to 1.5 mm or less, which is 150 times the amount of projection of the print wire 142 from the front surface 168 of front end guide 144 in the standby position, it is unlikely that lubricant 150 would be transferred onto ink ribbon 152 even if ink ribbon 152 is slackened as often occurs under normal printing conditions. This has been verified experimentally.

In this embodiment of the invention, the likelihood of lubricant 150 leaking out of guide holes 172 and coming in direct contact with ink ribbon 152 is substantially decreased if not eliminated. Accordingly, even if printing head 112 is mounted face down and the viscosity and amount of lubricant are such that a conventional print head would leak lubricant onto the ink ribbon, this embodiment of the invention will maintain the lubricant 150 in such a manner (a sufficient distance away from ink ribbon 152) as to avoid leaking the lubricant onto ink ribbon 152.

The invention as disclosed herein includes seven (7) different embodiments. Accordingly, like elements in each embodiment are labeled with progressive numerals of common tens and units digits with the hundreds digit being progressively incremented in each embodiment, for example, projection 170 of the first embodiment is labeled projection 270 of the second embodiment.

Reference is next made to FIGS. 10A and 10B wherein a second embodiment of the invention is depicted. Projections 270 are formed so as to be equidistantly from the guide holes 272. In other words, each projection 270 has arcuate recesses 275 on the side confronting the guide holes 272. The purpose of and advantage of projections 270 are the same as that of projections 170 of the first embodiment. However, the difference is that the projections 270 are maintained at a constant distance from the arc-shaped edge of each guide hole, in a fashion similar to a concentric circle.

Reference is next made to the third through the seventh embodiments of the invention which are described in detail hereunder with reference to the accompanying drawings. These embodiments are directed to particular configurations of parts that prevent leakage of lubricant through clearances or gaps between the front end guide and the nose by means that are different from those employed in the first and second embodiments.

Particular reference is now made to FIGS. 11A, 11B, 12A and 12B, which disclose the third embodiment of the invention. A plurality of print wires 342 are slidably held within guide holes 372 in guide member 344, the diameters of which are slightly larger than that of each wire 342. Guide holes 371 are arranged in an intermediate guide 343. The intermediate guide 343 is held by intermediate guide grooves 365 provided in nose 346. The front end guide 344 has a mounting groove 376 on a side surface thereof, and a ring-like elastic member 378 is mounted in the mounting groove 376. An O-ring is used as the elastic member 378 in this embodiment. The front end guide member 344 is inserted into front end guide grooves 363 of nose 346. A side plate 377 supporting guide member 344 is formed with a pair of spaced holes 379 which receive fusing pegs 380 projecting from nose 346 to join the nose and the front end guide member by fusing. Grooves 367 are provided at corresponding portions of nose 346 so that the elastic members 378 can be secured surely. The two members are secured by each member abutting against elastic member 378.

Side plate 377 of front end guide member 344 includes an injection hole 381 that allows a lubricant 350 of appropriate viscosity to be injected therein after the front end guide member 344, intermediate guide 343 and print wires 342 have been assembled. The injected lubricant 350 is kept in a portion of print head 312 surrounded by front end guide 344, intermediate guide 343 and nose 346. Under this embodiment, even if a low viscosity component of the lubricant 350 slowly leaks through clearances or gaps between the front end guide member 344 and the nose 346, such leakage or lubricant flow of the component is eliminated or stopped by the elastic member 378 at the position where the elastic member 378 is located and, as a result, no lubricant 350 is leaked onto or in contact with ink ribbon 352.

Figure 13A:
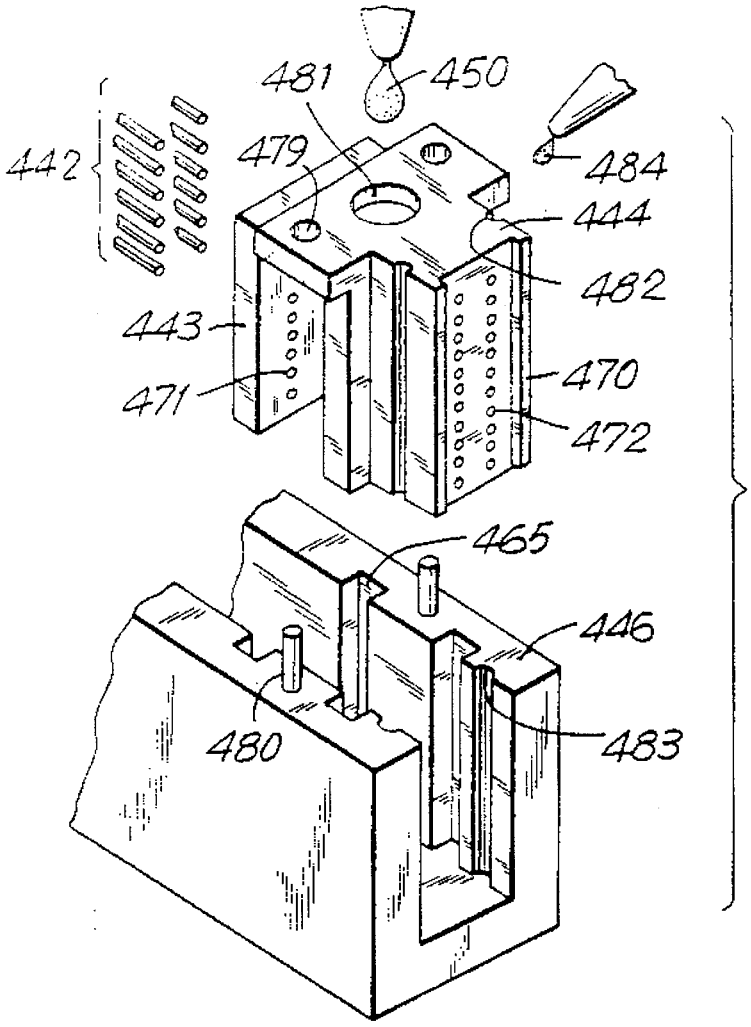
FIG. 13A is an exploded fragmentary perspective view of the front end of a print head in accordance with a fourth embodiment of the invention.
Figure 13B:
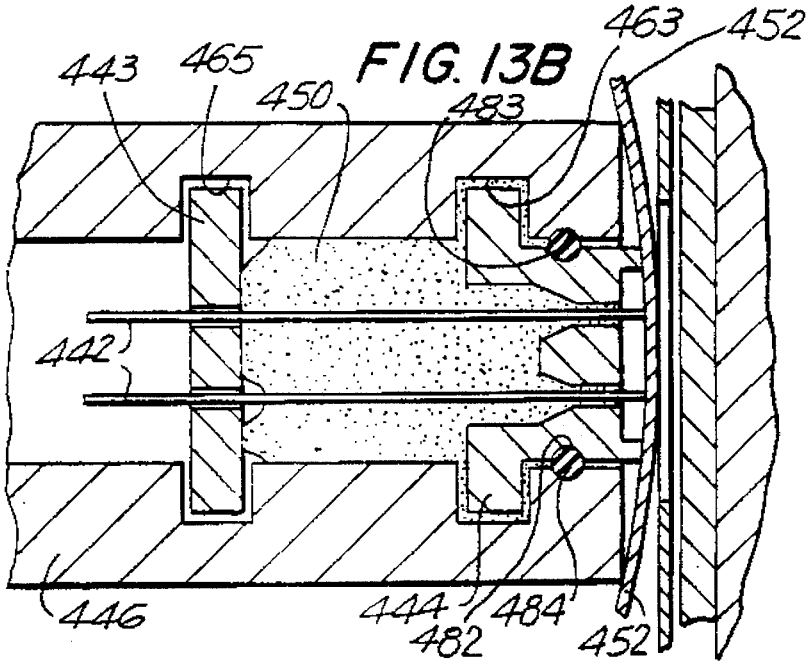
FIG. 13B is a sectional view of the assembled front end of the print head of FIG. 12B.

Reference is next made to FIGS. 13A and 13B, wherein a fourth embodiment of the invention is depicted. The fourth embodiment of the invention is generally constructed similar to that of the third embodiment of the invention. Accordingly, discussion will only be had to those points wherein the fourth embodiment of the invention differs from the third embodiment of the invention.

Front end guide member 444 has a groove 482 on two opposed side surfaces thereof, and nose 446 has grooves 483 at positions facing grooves 482 of front end guide member 444. When front end guide member 444 is coupled to nose 446, a shield member 484 is injected into the space between the grooves 482 and 483 of front end guide member 444 and nose 446, respectively. In the preferred embodiment, silicone rubber is used as shield member 484. However, any other material that is impermeable to lubricant 450 may be used. Furthermore, an adhesive or the like may be used so long as the adhesive has a shielding property. Accordingly, when the lubricant 450 is injected into the print head thereafter, the lubricant 450 is maintained in its position because there are no gaps or clearances between the front end guide member 444 and nose 446 for lubricant 450 to flow out of. Thus, there is no leakage of lubricant 450 onto ink ribbon 452.

Figure 14A:
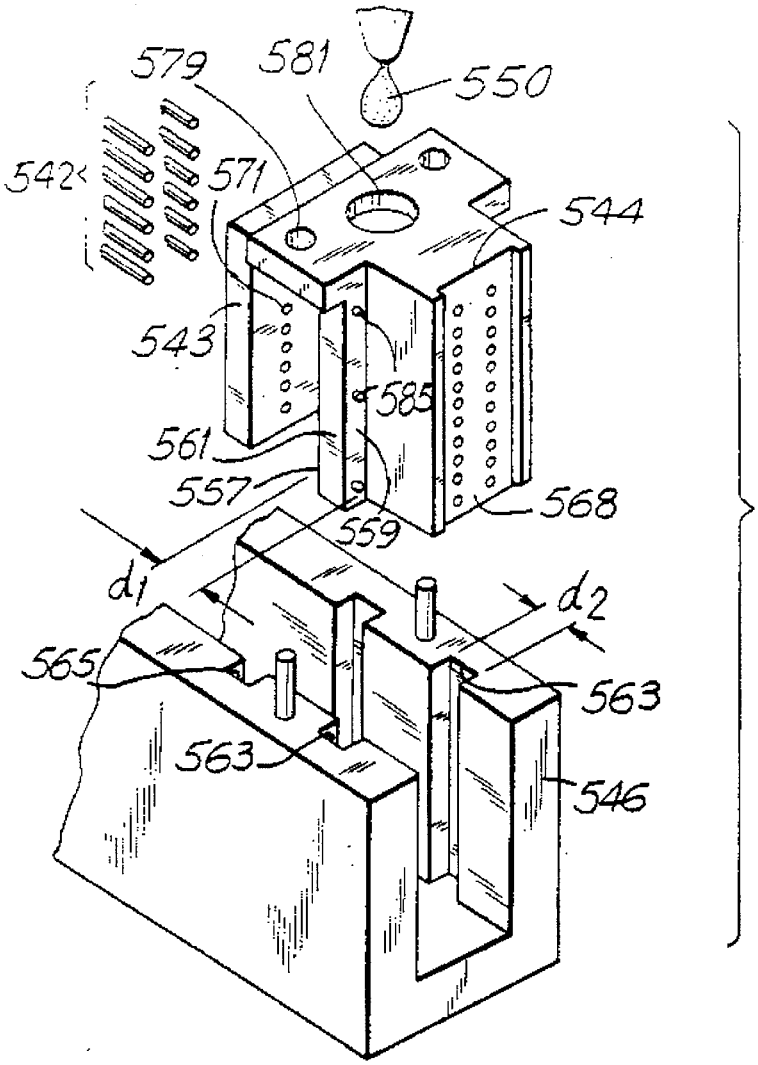
FIG. 14A is an exploded fragmentary perspective view showing the front end of a print head in accordance with a fifth embodiment of the invention.
Figure 14B:
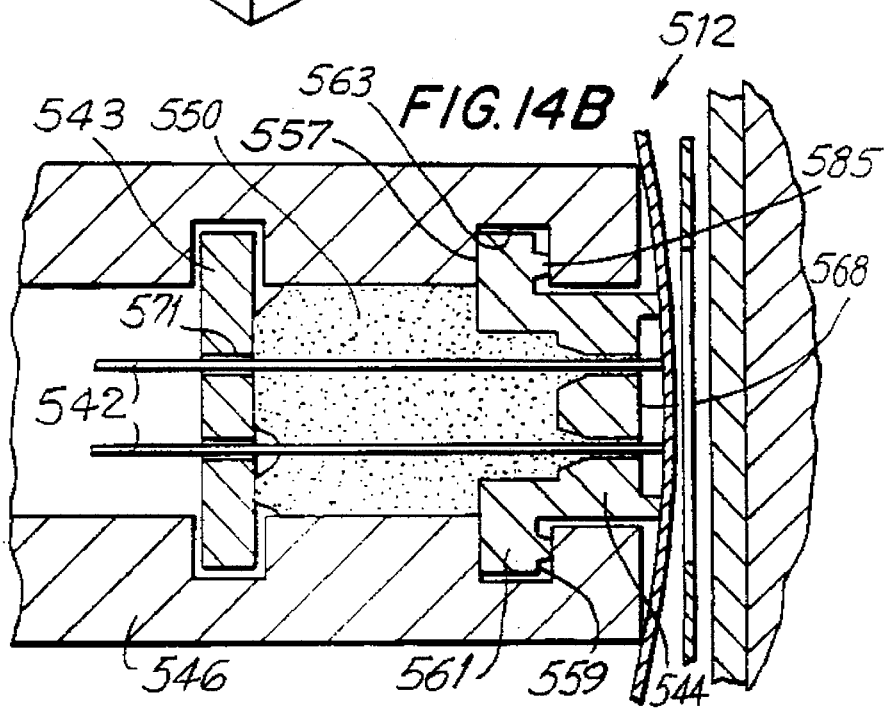
FIG. 14B is a sectional view of the assembled front end of the print head of FIG. 14A.
Figure 15A:
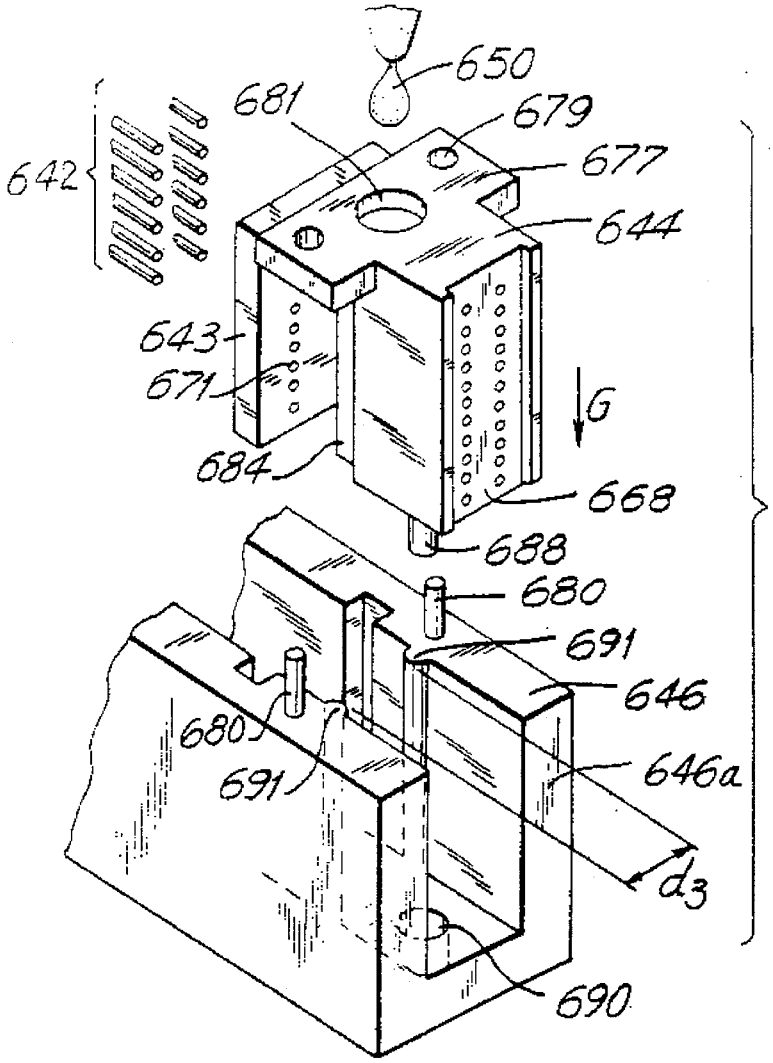
FIG. 15A is an exploded fragmentary perspective view showing the front end of a print head in accordance with a sixth embodiment of the invention.
Figure 15B:
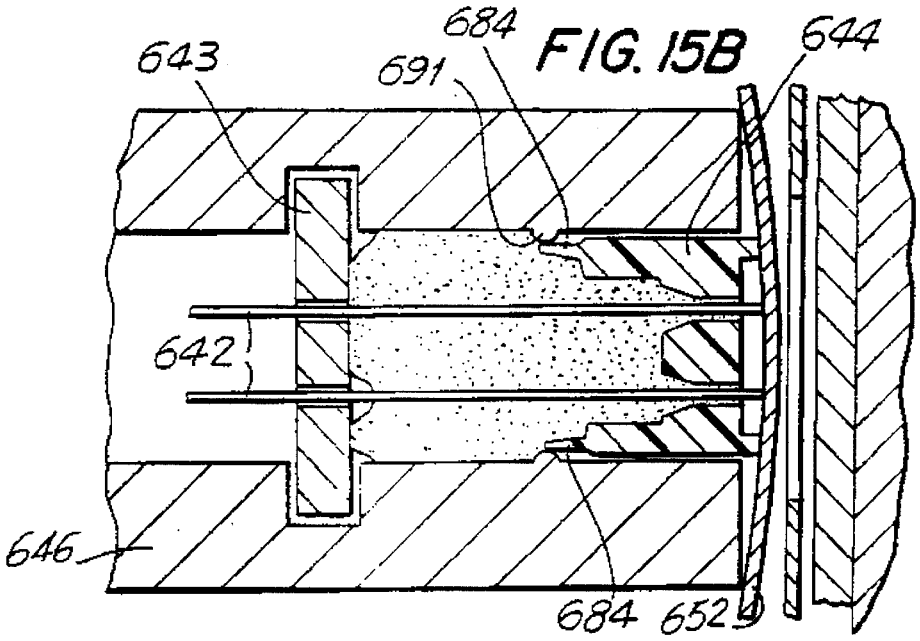
FIG. 15B is a sectional view of the assembled front end of the print head of FIG. 15A.
Figure 16A:
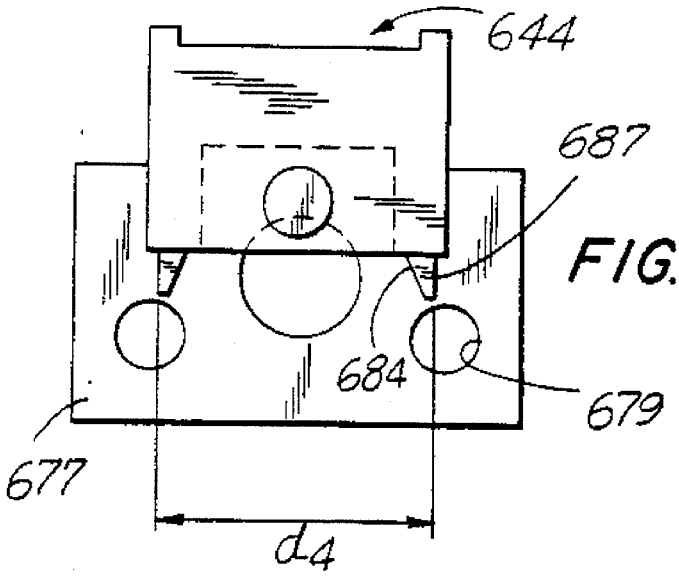
FIG. 16A is a top plan view of the guide member of the sixth embodiment of the invention.
Figure 16B:
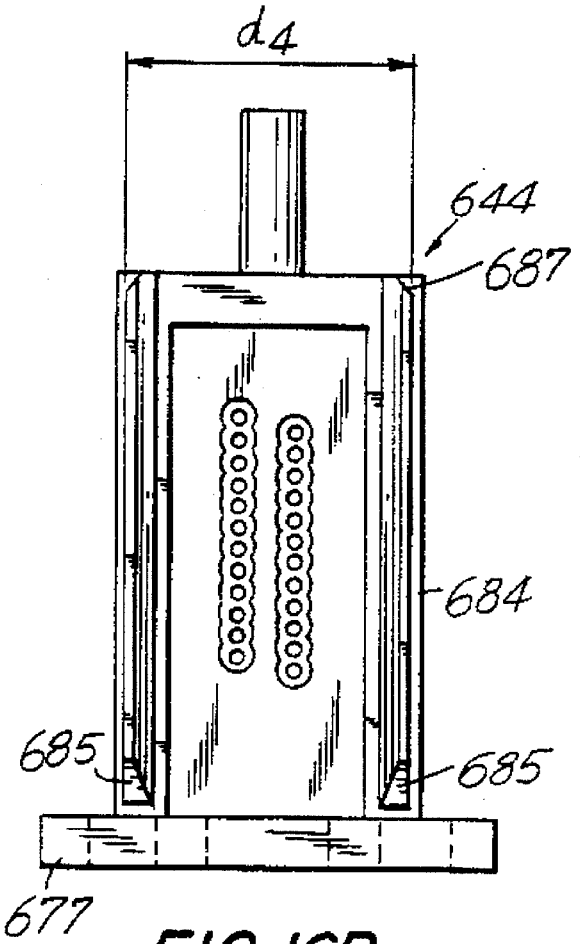
FIG. 16B is a front elevational view of the guide member of FIG. 16A.
Figure 16C:
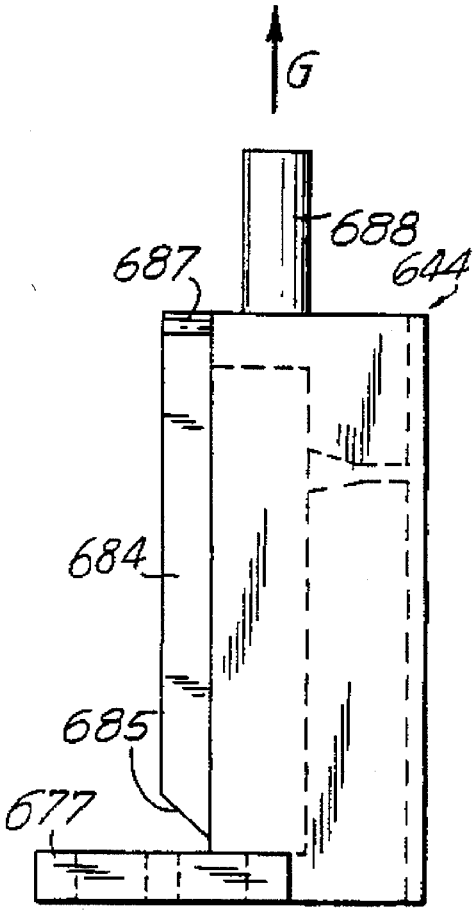
FIG. 16C is a side elevational view of the guide member of FIG. 16A.

Particular attention is next directed to FIGS. 14A and 14B, wherein a fifth embodiment of the invention is depicted. The fifth embodiment of the invention has a general construction similar to that of the third and fourth embodiments. Accordingly, only the points different from the third embodiment are described.

Front end guide 544 is provided with a plurality of projections 585 on each of the front end side surfaces 559 of ribs 561. Ribs 561 are positioned to be inserted into grooves 563 on inner surfaces of nose 546. The length $d_1$ from surface 557 of ribs 561 to the tip of each projection 585 is designed to be slightly larger than the width $d_2$ of the groove 563 of nose 546. The surface 557 comes in pressing contact with the surface of groove 563 and is opposite to the surface 559 having the projections 585 located thereon. The print head 512 is designed such that the tips of projections 585 are crushed when front end guide member 544 is inserted into nose 546. Accordingly, surface 557 is forced into intimate contact with grooves 563. The intimate contact extends along the length of each groove 563. Accordingly, even if the lubricant 550 that is injected into print head 512 is of an improper viscosity or amount, the intimate contact between grooves 563 of nose 546 and the side surface 557 of front end guide member 544, along the entire length thereof, prevents lubricant 550 from leaking out onto the front surface 568 of front end guide member 544. Accordingly, lubricant 550 is prevented from reaching ink ribbon 552. While the projections are provided on the front end guide 544 in this embodiment, it goes without saying that the same advantages can be obtained by switching the arrangement such that the projections are provided on a wall of groove 563.

Reference is next made to FIGS. 15A, 15B and 16A–16C, wherein a sixth embodiment of the invention is depicted. The sixth embodiment has a similar general construction to that of the third embodiment and accordingly only those points different from the third embodiment will be described.

Front end guide member 644 includes walls 684 extending rearwardly in a direction vertical to front end surface 668. Walls 684 are tapered toward the back of the front end guide 644. Front end guide 644 is made of resin and walls 684 can be elastically deformed inwardly. In order to reduce the rigidity of the walls 684 in the inward direction, they include cut out portions 685 (FIGS. 16A and 16B) which face the bottom portion 677. Walls 684 include chamfered portions 687 in a direction G of insertion of front end guide member 644 into nose 646. Front end guide member 644 includes a pin 688 which is disposed in the insertion direction G. Pin 688 is positioned on the opposite side of guide member 644 to bottom portion 677.

Nose 646 is constructed with a through hole 690 which is aligned in the insertion direction G. Pin 688 of front end guide member 644 is designed to fit into through hole 690 when front end guide 644 is inserted into nose 646. Nose 646 also includes pins 680 which are fitted into fusing holes 679 at the time of inserting the front end guide 644 within nose 646. The inside walls of nose 646 include elongated ribs 691 which extend inwardly and have a semicircular cross-section. Front end guide member 644 is formed to be inserted past projections 691. A distance $d_3$ extends between the apex of the two ribs 691. This distance $d_3$ is designed to be slightly smaller than the distance $d_4$ between the outer surfaces of walls 684 of front end guide 644. Accordingly, when front end guide 644 is inserted into nose 646, walls 684 elastically deform inwardly at the moment of insertion of front end guide 644, thereby causing wall 684 to come in intimate contact with continuously extending lips 691. Chamfered portions 687 of walls 684 allow for smooth insertion of front end guide member 644 into nose 646.

Front end guide member 644 is held by a tool (not shown) so that the front end surface 668 of front end guide member 644 and front end surface 646*a* of nose 646 maintain a co-planar relationship and, under this condition, pin 688 in through hole 690 as well as pins 680 in fusing holes 679 are fused together and thereby positioning and fixing the guide member relative to the nose.

The walls 684 are formed in the direction orthogonal to front end surface 668 of front end guide member 644 and front end surface 646a of nose 646, so that the surfaces can be formed co-planar without being restricted by walls 684. Although clearances or gaps are formed by the cut-out portions 685 between the walls 684 and the bottom portion 677, the surfaces that come in intimate contact cover substantially the same area as the area into which the lubricant 650 is injected. Thus, the amount of seepage of lubricant 650 is minimized and there is no likelihood that lubricant 650 will adhere to ink ribbon 652. In this embodiment, the elastically deforming walls are provided on the front end guide member 644. However, the same advantages can be obtained by providing nose 646 with walls that are capable of elastic deformation and providing the front end guide member 644 with more rigid walls.

Figure 17A:
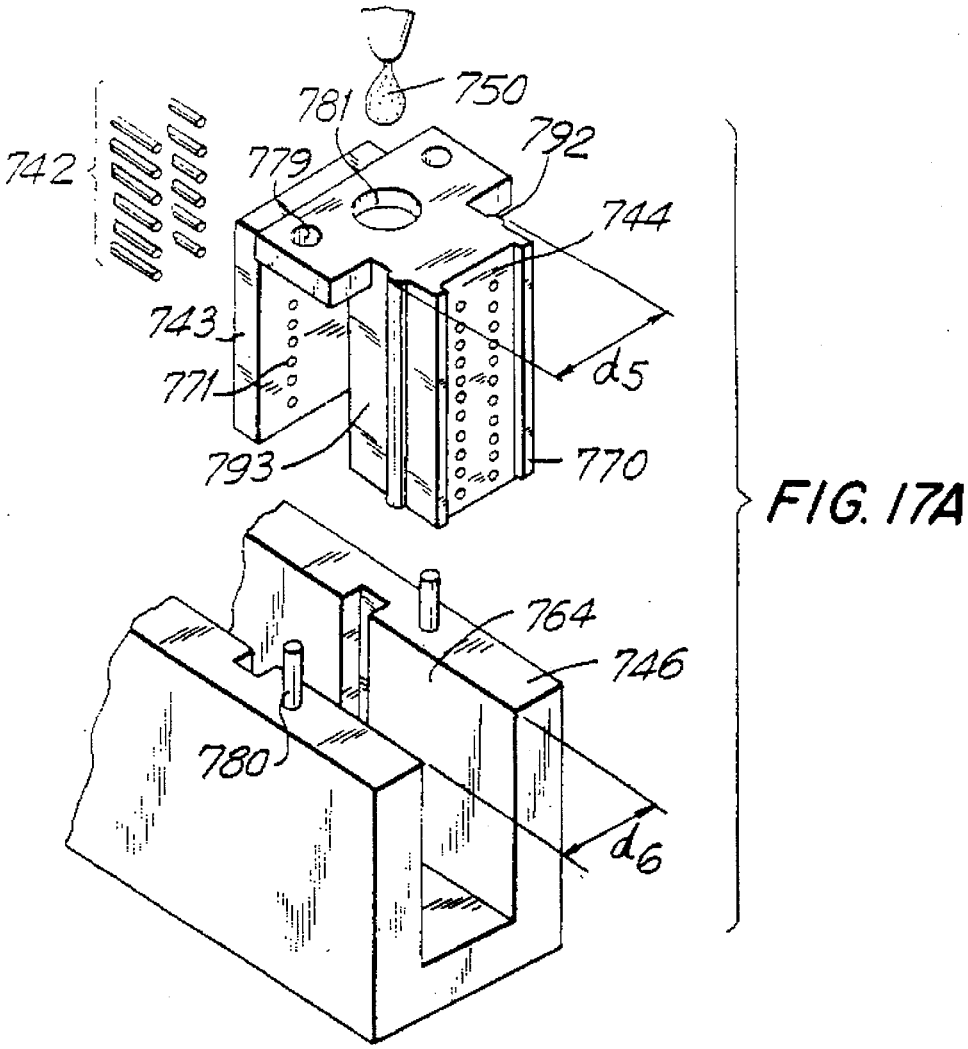
FIG. 17A is an exploded fragmentary perspective view showing the front end of a print head in accordance with a seventh embodiment of the invention.
Figure 17B:
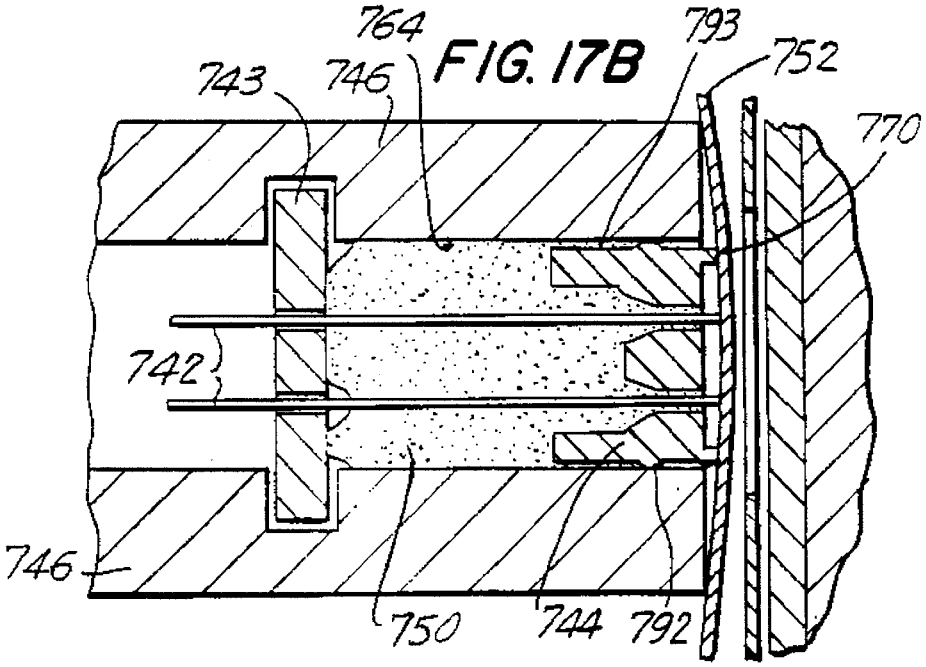
FIG. 17B is a sectional view of the assembled front end of the print head of FIG. 17A.

Reference is next made to FIGS. 17A and 17B, wherein a seventh embodiment of the invention is depicted. Since the seventh embodiment of the invention has a general construction similar to that of the third embodiment, only those points that are different from the third embodiment will be described in detail.

The front end guide member 744 is provided with peripheral elongated ribs 792 which are continuously outwardly extending and are provided on both side surfaces 793 of front end guide member 744. A distance $d_5$ is provided between the apex of each projecting rib 792 and is designed to be slightly greater than the distance $d_6$ between the inner walls 764 of the front end guide accommodating portion of nose 746. Accordingly, the outer surface of each peripheral rib 792 is slightly deformed at the time that the front end guide member 744 is inserted into nose 746. The deformation of the ribs 792 of front end guide member 744 is a plastic deformation that provides for an intimate contact between front end guide member 744 and nose 746. As a result of this deformation and intimate contact, there is no likelihood that the lubricant 750 will leak out of the inside of the front end guide 744, between the front end guide member 744 and nose 746. Accordingly, no lubricant 750 will adhere to ink ribbon 752. While the continuously extending ribs are provided on front end guide member 744, the same result can be obtained by providing ribs on nose 746 and causing deformation thereof by insertion of a front end guide that is slightly wider than the distance between the peripheral lips of the nose portion.

This invention is disclosed in conjunction with an impact dot printer having a so called "clapper" type head in which the wires are projected by the attraction of electromagnets. However, the clapper type impact dot printer has been used as an exemplary model of a impact dot printer which the invention can be applied to. This invention can be applied to any type of impact dot printer having print wires which are projected from the front end guide. Accordingly, such other examples of impact dot printers in which this invention can be used are the so called "spring-charged" type head using permanent magnets or, to one have a piezo type impact dot head using piezoelectric elements.

As described hereinabove and reiterated now, the invention is characterized as providing a construction for an impact dot printer head, wherein the required lubricant for the wires is maintained within the back of the front end guide and, further, where any lubricant that seeps through the front end guide is prevented from contacting the ink ribbon. This is accomplished in two ways. The first embodiment of the invention provides a construction that is used to bias the ink ribbon away from the front surface of the front end guide. This embodiment includes projections on the print wire projecting side surface of the front end guide of the impact dot printer which bias the ink ribbon away from the front surface of the front end guide. The impact dot printer includes a plurality of print wires, the front end guide, having guide holes for guiding the print wires to print positions, and a guide holding member (nosepiece), for holding the front end guide. A lubricant is applied behind the front end guide to lubricate in the guide holes of the front end guide. The ink ribbon is provided between the front end guide and a print sheet, and printing dots are formed by projecting the wires against the ink ribbon, thereby forming dots on the print sheet at appropriate times. As a result of the above constructions, the lubricant seeping from the guide holes is no longer brought into direct contact with the ink ribbon due to the projections which bias the ribbon far enough away from the front surface of the front end guide to prevent contact of the lubricant against the ink ribbon. Accordingly, defective printing attributable to the lose of ink components on the ink ribbon caused by a transfer of lubricant onto the ink ribbon is thereby reduced. Accordingly, the impact dot printer of the present invention is free from defective printing caused by the transfer of lubricant onto the ink ribbon.

Further, this invention also provides a means for preventing seepage of the lubricant through clearances or gaps between the front end guide and the guide holding member (nosepiece). In conventional printing apparatus, the gaps between the front end guide and nose member contribute to the defective printing resulting when lubricant contacts the ink ribbon. This extra lubricant leakage through the gaps between the guide holes and nose member is eliminated by the present invention. Therefore, an impact dot printer having stable printing quality and excellent reliability and durability irrespective of the direction in which the print head is mounted on the printer can be provided inexpensively.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A print head for an impact dot printer for printing on a printing medium by striking an ink ribbon thereagainst, comprising:

a plurality of print wires;

a guide having guide holes positioned to guide said print wires to predetermined positions, said guide having a front surface being on a side of said guide through which said print wires extend and facing an ink ribbon;

a guide holding member positioned and constructed to hold and position said guide;

a reservoir including at least portions of said guide and guide holding member constructed to contain a lubricant in a portion of said print head for lubricating said print wires as they pass through said guide holes, said print wires extending through said reservoir for contact with the lubricant;

a printing actuation device coupled to the print wires and constructed to project said print wires at appropriate times into the ink ribbon located between said guide and the printing medium; and at least one projection formed on said front surface of said guide extending away from the front surface of said guide, extending beyond said guide holding member and positioned to hold said ink ribbon away from said front surface of said guide during operation of said print head and while said print head is not operating, said at least one projection preventing contact of said ink ribbon with lubricant which has passed through said guide holes to said guide.

2. The print head as claimed in claim 1, wherein said guide is a front end guide.

3. The print head as claimed in claim 1, wherein said print wires extend a predetermined distance beyond said front surface when in a standby position.

4. The print head as claimed in claim 3, wherein a height of each said projection above said front surface of said guide means is at least equal to the amount of projection of said print wires above said front surface of said guide when in said standby position.

5. The print head as claimed in claim 3, wherein said predetermined distance is 0.01 mm.

6. The print head as claimed in claim 1, wherein each said projection has a height at least equal to 0.01 mm.

7. The print head as claimed in claim 4, wherein said height of each projection is at least equal to 0.01 mm.

8. The print head as claimed in claim 4, wherein a distance between a projection and an edge of a guide hole nearest said projection is a maximum of 150 times said predetermined distance.

9. The print head as claimed in claim 8, wherein said distance between a projection and said edge of said guide hole nearest said projection is a maximum of 1.5 mm.

10. The print head as claimed in claim 3, wherein a distance between a projection and an edge of said guide hole nearest said projection is a maximum of 150 times said predetermined distance.

11. The print head as claimed in claim 10, wherein said distance between a projection and said edge of said guide hole nearest said projection is a maximum of 1.5 mm.

12. The print head as claimed in claim 4, wherein said projection comprises an elongated rib extending from said front surface of said guide.

13. The print head as claimed in claim 4, wherein at least one said projection includes arcuate recesses on a side thereof facing said guide holes and aligned therewith.

14. The print head as claimed in claim 1, wherein said projection comprises an elongated rib extending from said front surface of said guide.

15. The print head as claimed in claim 1, wherein at least one said projection includes arcuate recesses on a side thereof facing said guide holes and aligned therewith.

16. The print head as claimed in claim 1, further comprising a means for preventing seepage of lubricant through clearances between said guide and said guide holding member.

17. The print head as claimed in claim 16, wherein said guide is press fit into said guide holding member.

18. The print head as claimed in claim 17, wherein a friction seal is created by said press fit of said guide in said guide holding member.

19. The print head as claimed in claim 16, wherein said guide holding member is formed with an opening shaped to receive the guide, said guide being formed with grooves in opposed side surfaces thereof facing the walls of said opening in said guide holding member, the walls of said opening in said guide holding member being formed with grooves in registration with corresponding grooves in said guide holding member, said opposing pairs of grooves forming a gap.

20. The print head as claimed in claim 19, including means for filling said gap and preventing said lubricant from seeping therepast.

21. The print head as claimed in claim 19, including at least one O-ring disposed within said gap for preventing said lubricant from seeping therepast.

22. The print head as claimed in claim 19, including silicone rubber disposed within said gap.

23. The print head as claimed in claim 16, wherein said guide holding member is formed with an opening shaped to receive the guide, one of said guide and guide holding member opening including elongated ribs on opposed side surfaces thereof facing surfaces of the other of said guide and said opening in said guide holding member, the surfaces of the other of said guide and said opening in said guide holding member being formed with elongated channels positioned to receive said ribs therein.

24. The print head as claimed in claim 23, said ribs including projections extending substantially orthogonal to a direction of insertion of said ribs within said channels.

25. The print head as claimed in claim 24, wherein a width of said ribs and projections is larger than a width of said channel, whereby said projections are deformed to hold one side of the ribs in pressing engagement with a facing side of the corresponding channels.

26. The print head as claimed in claim 16, wherein said guide holding member is formed with an opening shaped to receive the guide, said one of said guide and the opening in said guide holding member being formed with at least one rib extending essentially the width of a guide means facing a surface of the opening, said at least one rib contacting the facing surface of the other of said guide and the opening in said guide holding member.

27. The print head as claimed in claim 26, said rib or opposing surface being deformable for providing a tight contact between said guide and guide holding member to essentially prevent the passage of lubricant from seeping to the front surface of the guide along a path therebetween.

28. The print head as claimed in claim 27, wherein said walls of said guide are thinned and resiliently engaged against said ribs.

29. The print head as claimed in claim 27, wherein said walls of said guide each include a chamfered surface at an end thereof for facilitating insertion within said guide holding member.

30. The print head as claimed in claim 27, wherein said guide is formed of resin.

31. The print head as claimed in claim 16, wherein said guide holding member is formed with a pair of opposed walls projecting in a direction away from the opposed side surfaces of the guide, each of said walls of said guide facing a wall of said opening of said guide holding member, said facing walls of said opening of said guide holding member each being formed with a projecting rib extending essentially the length of said wall of said guide for engagement thereagainst.

32. The print head as claimed in claim 16, wherein said guide holding member is formed with an opening shaped to receive the guide, said guide and said opening of said guide holding member being dimensioned so that at least a pair of opposing surfaces thereof are press fit when said guide is inserted in the opening of said guide holding member.

33. The print head as claimed in claim 16, wherein said guide holding member is formed with an opening shaped to receive the guide, including means for securing said guide to said guide holding member.

34. The print head as claimed in claim 33, wherein said securing means includes a fusing pin for joining said guide and said guide holding member by fusing, disposed upon said guide in registration with a bore provided in said guide holding member.

35. The print head as claimed in claim 33, wherein said securing means includes a fusing pin for joining said guide and said guide holding member by fusing within said guide holding member in registration with a bore within said guide.

36. The print head as claimed in claim 16, said guide including a first deformable lip and a second deformable lip, a distance between said first and second deformable lips being smaller than a distance within said guide holding member for receiving said guide member.

37. The print head as claimed in claim 36, wherein said first and second deformable lips conform to said guide holding member when inserted therein.

38. A printer head for an impact dot printer for printing on a printing medium by striking an ink ribbon thereagainst, comprising:

a plurality of print wires;

a guide having guide holes positioned to guide said print wires to predetermined print positions, said guide having a front surface being on a side of said guide through which said print wires extend and facing an ink ribbon;

a guide holding member positioned and constructed to hold and position said guide;

a plurality of retaining members;

a reservoir including at least a plurality of retaining members, said retaining members preventing a lubricant within said print head for lubricating said print wires as they pass through said guide holes from leaking from said reservoir, said print wires extending through said reservoir for contact: with the lubricant whereby said retaining members prevent seepage of lubricant through clearances between said guide and said guide holding member; and a printing actuation device coupled to the print wires and constructed to project said print wires at appropriate times into the ink ribbon located between said guide and the printing medium, wherein said guide holding means is formed with an opening shaped to receive the guide means, said guide means being formed with grooves in opposed side surfaces thereof facing the walls of said opening in said guide holding means, the walls of said opening in said guide holding means being formed with grooves in registration with corresponding grooves in said guide holding means, said opposing pairs of grooves forming a gap.

39. The print head as claimed in claim 38, including silicone rubber disposed within said gap.

40. The print head as claimed in claim 38, including means for filling said gap and preventing said lubricant from seeping therepast.

41. The print head as claimed in claim 38, including at least one O-ring disposed within said gap for preventing said lubricant from seeping therepast.

42. A printer head for an impact dot printer for printing on a printing medium by striking an ink ribbon thereagainst, comprising:

a plurality of print wires;

a guide having guide holes positioned to guide said print wires to predetermined print positions, said guide having a from surface being on a side of said guide through which said print wires extend and facing an ink ribbon;

a guide holding member positioned and constructed to hold and position said guide;

a plurality of retaining members;

a reservoir including at least a plurality of retaining members, said retaining members preventing a lubricant within said print head for lubricating said prim wires as they pass through said guide holes from leaking from said reservoir, said print wires extending through said reservoir for contact with the lubricant whereby said retaining members prevent seepage of lubricant through clearances between said guide and said guide holding member; and a printing actuation device coupled to the print wires and constructed to project said print wires appropriate times into the ink ribbon located between said guide and the printing medium, wherein said guide holding means is formed with an opening shaped to receive the guide means, one of said guide means and guide holding means opening including elongated ribs on opposed side surfaces thereof facing surfaces of the other of said guide means in said guide opening in said guide holding means, the surfaces of the other of said guide means and said opening in said guide holding means being formed with elongated channels positioned to receive said ribs therein, said ribs including projections extending substantially orthogonal to a direction of insertion of said ribs within said channels.

43. The print head as claimed in claim 42, wherein a width of said ribs and projections is larger than a width of said channel, whereby said projections are deformed to hold one side of the ribs in pressing engagement with a facing side of the corresponding channels.

44. A printer head for an impact dot printer for priming on a printing medium by striking an ink ribbon thereagainst, comprising:

a plurality of print wires;

a guide having guide holes positioned to guide said print wires to predetermined print positions, said guide having a front surface being on a side of said guide through which said print wires extend and facing the ink ribbon;

a guide holding member positioned and constructed to hold and position said guide;

a plurality of retaining members;

a reservoir formed at least in part from said guide holding member and guide and including at least a plurality of retaining members intermediate said guide and guide holding member in a region between the interior of said reservoir and front surface of said guide, said retaining members preventing a lubricant within said interior of said reservoir, provided to lubricate said print wires as they pass through said guide holes, from leaking from said reservoir, said print wires extending through said reservoir for contact with the lubricant whereby said retaining members prevent seepage of lubricant through clearances between said guide and said guide holding member; and a printing actuation device coupled to the print wires and constructed to project said print wires at appropriate times into the ink ribbon located between said guide and the printing medium.

45. The print head as claimed in claim 44, wherein said guide holding member is formed with an opening shaped to receive the guide, one of said guide and guide holding member opening including elongated ribs on opposed side surfaces thereof facing surfaces of the other of said guide and said opening in said guide holding member, the surfaces of the other of said guide and said opening in said guide holding member being formed with elongated channels positioned to receive said ribs therein.

46. The print head as claimed in claim 44, wherein said guide holding member is formed with an opening shaped to receive the guide, one of said guide and the opening in said guide holding member being formed with at least one rib extending essentially the width of a guide facing a surface of the opening, said at least one rib contacting the facing surface of the other of said guide and the opening in said guide holding member.

47. The print head as claimed in claim 46, said rib or opposing surface being deformable for providing a tight contact between said guide and guide holding member to essentially prevent the passage of lubricant from seeping to the front surface of the guide along a path therebetween.

48. The print head as claimed in claim 47, wherein said walls of said guide are thinned and resiliently engaged against said ribs.

49. The print head as claimed in claim 47, wherein said walls of said guide each include a chamfered surface at an end thereof for facilitating insertion within said guide holding member.

50. The print head as claimed in claim 47, wherein said guide is formed of resin.

51. The print head as claimed in claim 44, wherein said guide holding member is formed with a pair of opposed walls projecting in a direction away from the opposed side surfaces of the guide, each of said walls of said guide facing a wall of said opening of said guide holding member, said facing walls of said opening of said guide holding member each being formed with a projecting rib extending essentially the length of said wall of said guide for engagement thereagainst.

52. The print head as claimed in claim 44, wherein said guide holding member is formed with an opening shape to receive the guide, said guide and said opening of said guide holding member being dimensioned so that at least a pair of opposing surfaces thereof are press fit when said guide is inserted in the opening of said guide holding member.

53. The print head as claimed in claim 44, wherein said guide holding member is formed with an opening shaped to receive the guide, including means for securing said guide to said guide holding member.

54. A printer head for an impact dot printer for printing on a printing medium by striking an ink ribbon thereagainst, comprising:

a plurality of print wires;

a guide having guide holes positioned to guide said print wires to predetermined print positions, said guide having a front surface being on a side of said guide through which said print wires extend and facing an ink ribbon;

a guide holding member positioned and constructed to hold and position said guide;

a plurality of retaining members;

a reservoir including at least a plurality of retaining members, said retaining members preventing a lubricant within said print head for lubricating said print wires as the pass through said guide holes from leaking from said reservoir, said print wires extending through said reservoir for contact with the lubricant whereby said retaining members prevent seepage of lubricant through clearances between said guide and said guide holding member; and a printing actuation device coupled to the print wires and constructed to project said print wires at appropriate times into the ink ribbon located between said guide and the printing medium, wherein said guide holding means is formed with an opening shaped to receive the guide means, including means for securing said guide means to said guide holding means, wherein said securing means includes a pin disposed upon said guide means in registration with a bore provided in said guide holding means.

55. A printer head for an impact dot primer for printing on a printing medium by striking an ink ribbon thereagainst, comprising:

a plurality of print wires;

a guide having guide holes positioned to guide said print wires to predetermined positions, said guide having a from surface being on a side of said guide through which said print wires extend and facing an ink ribbon;

a guide holding member positioned and constructed to hold and position said guide;

a plurality of retaining members;

a reservoir including at least a plurality of retaining members, said retaining members preventing a lubricant within said print head for lubricating said print wires as they pass through said guide holes from leaking from said reservoir, said print wires extending through said reservoir for contact with the lubricant whereby said retaining members prevent seepage of lubricant through clearances between said guide and said guide holding member; and a printing actuation device coupled to the print wires and constructed to project said print wires at appropriate times into the ink ribbon located between said guide and the printing medium, wherein said guide holding means is formed with an opening shaped to receive the guide means, including means for securing said guide means to said guide holding means, wherein said securing means includes a pin within said guide holding means in registration with a bore within said guide means.

56. A printer head for an impact dot printer for printing on a printing medium by striking an ink ribbon thereagainst, comprising:

a plurality of print wires;

a guide having guide holes positioned to guide said print wires to predetermined print positions, said guide having a front surface being on a side of said guide through which said print wires extend and facing an ink ribbon;

guide holding member positioned and constructed to hold and position said guide;

a plurality of retaining members;

a reservoir including at least a plurality of retaining members, said retaining members preventing a lubricant within said print head for lubricating said print wires as the pass through said guide holes from leaking from said reservoir, said print wires extending through said reservoir for contact with the lubricant whereby said retaining members prevent seepage of lubricant through clearances between said guide and said guide holding member; and a printing actuation device coupled to the print wires and constructed to project said print wires at appropriate times into the ink ribbon located between said guide and the printing medium, said guide means including a first deformable lip and a second deformable lip, a distance between said first and second deformable lips being smaller than a distance within said guide holding means for receiving said guide member.

57. The print head as claimed in claim 56, wherein said first and second deformable lips conform to said guide holding member when inserted therein.

* * * * *